US012527424B2

(12) United States Patent
Chuang

(10) Patent No.: US 12,527,424 B2
(45) Date of Patent: Jan. 20, 2026

(54) HANGING WEIGHT STRUCTURE FOR A CURTAIN

(71) Applicants: ABO WINDOW FASHION CORP, Chino, CA (US); Shan-Chi Chuang, New Taipei (TW)

(72) Inventor: Shan-Chi Chuang, New Taipei (TW)

(73) Assignees: ABO WINDOW FASHION CORP., Chino, CA (US); Shan-Chi Chuang, New Taipei (TW)

( * ) Notice: Subject to any disclaimer, the term of this patent is extended or adjusted under 35 U.S.C. 154(b) by 289 days.

(21) Appl. No.: 18/114,958

(22) Filed: Feb. 27, 2023

(65) Prior Publication Data

US 2024/0285111 A1 Aug. 29, 2024

(51) Int. Cl.
*A47H 23/01* (2006.01)
*A47H 23/02* (2006.01)

(52) U.S. Cl.
CPC ..... *A47H 23/02* (2013.01); *A47H 23/01* (2013.01)

(58) Field of Classification Search
CPC .. A47H 23/01; A47H 2001/047; A47H 23/02; E06B 3/46; E06B 3/469; E06B 9/36; E06B 9/367; E05D 15/06; E05D 15/0656
See application file for complete search history.

(56) References Cited

U.S. PATENT DOCUMENTS

| | | | | |
|---|---|---|---|---|
| 2,833,346 | A * | 5/1958 | Preston | E06B 3/922 160/197 |
| 3,529,382 | A * | 9/1970 | Salvarola | E06B 3/922 160/202 |
| 6,892,783 | B1 * | 5/2005 | Comeau | A47H 23/01 160/98 |
| 2017/0292304 | A1 * | 10/2017 | Sidwell | E05D 15/0656 |
| 2021/0293086 | A1 * | 9/2021 | Chuang | A47H 23/01 |
| 2022/0338660 | A1 | 10/2022 | Chuang | |

* cited by examiner

*Primary Examiner* — Catherine A Kelly
*Assistant Examiner* — Jeremy C Ramsey

(57) ABSTRACT

A hanging weight structure for a curtain has a hanging weight member and two cover caps. A top portion of the hanging weight member has an assembling slot configured for accepting a curtain sheet. The two cover caps are respectively jacketed onto two ends of the hanging weight member and blocks the connecting member. One of the cover caps has a connecting member toward the hanging weight member and pushing against a side of the hanging weight member, and the connecting member has a concave shape capable of accepting another hanging weight member. A dividing member connects the connecting member and the cover cap, and a separating space is defined by the dividing member, and the cover cap and another hanging weight member. Another cover cap has a positioning bar parallel to the hanging weight member and is disposed at a same side as the connecting member for positioning.

3 Claims, 7 Drawing Sheets

HANGING WEIGHT STRUCTURE FOR A CURTAIN

BACKGROUND OF INVENTION

Field of Invention

The present invention relates to a curtain structure, and more particularly to a hanging weight structure for a curtain.

Description of Related Art

Generally, indoor space has windows for ventilation and lighting, and curtains are usually installed on the windows to block sunlight, increase privacy, or as decoration. Mostly, curtains are made of fabric or sheet materials which are soft and flexible, so a hanging weight member is usually installed on the bottom edge of the curtain, and the weight of the hanging weight member keeps the curtain flat and down. However, when the hanging member is used for vertical curtains or curtains that are spread horizontally, the bottom hem of the curtain sheet often appear uneven or with tangles.

Therefore, it is desirable to provide a hanging weight structure for a curtain to mitigate and/or obviate the aforementioned problems.

Therefore, it is desirable to provide a hanging weight structure for a curtain to mitigate and/or obviate the aforementioned problems.

SUMMARY OF THE INVENTION

An objective of present invention is to provide hanging weight structure for a curtain which is capable of improving the above-mention problems.

In order to achieve the above mentioned objective, a hanging weight structure for a curtain has a hanging weight member and two cover caps. A top portion of the hanging weight member has an assembling slot configured for accepting a curtain sheet. The two cover caps are respectively jacketed onto two ends of the hanging weight member and blocks the connecting member. One of the cover caps has a connecting member toward the hanging weight member and pushing against a side of the hanging weight member, and the connecting member has a concave shape capable of accepting another hanging weight member. A dividing member connects the connecting member and the cover cap, and a separating space is defined by the dividing member, and the cover cap and another hanging weight member. Another cover cap has a positioning bar parallel to the hanging weight member and is disposed at a same side as the connecting member for positioning.

Other objects, advantages, and novel features of invention will become more apparent from the following detailed description when taken in conjunction with the accompanying drawings.

DETAILED DESCRIPTION OF THE PREFERRED EMBODIMENT

Figure 1:
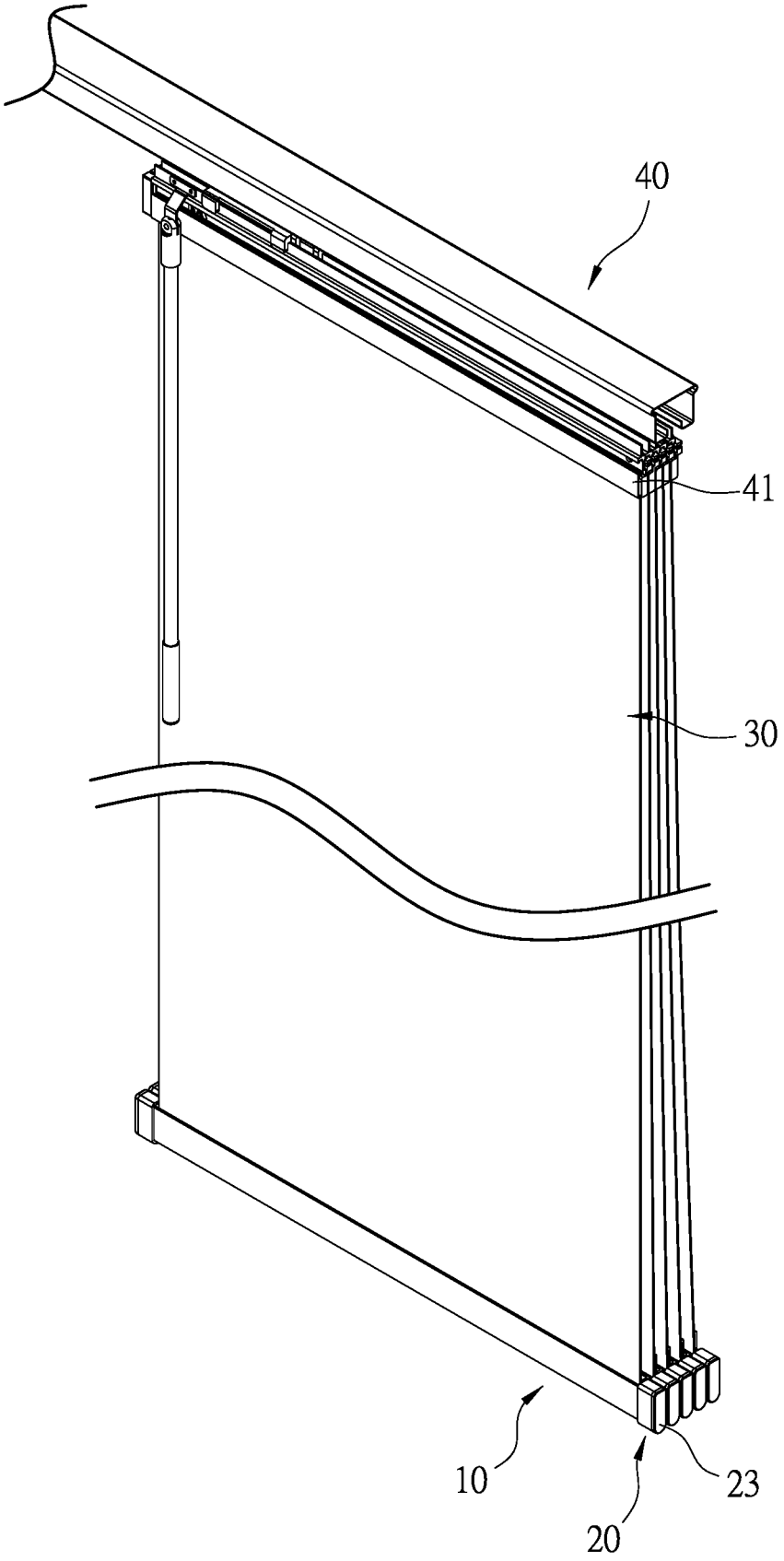
FIG. 1 is a perspective view of a preferred embodiment of the present invention.
Figure 2:
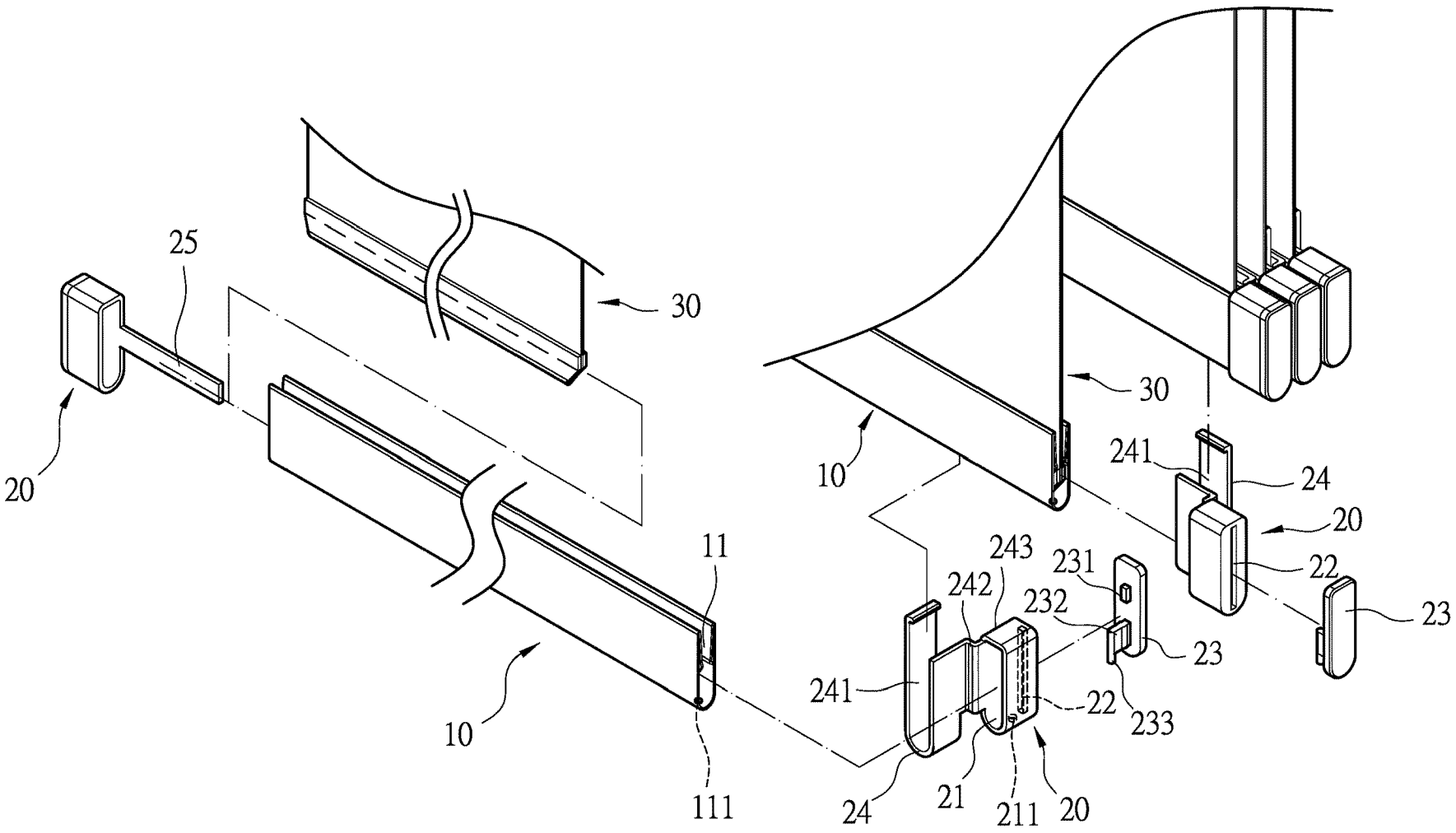
FIG. 2 is an exploded view of the preferred embodiment according of the present invention.
Figure 3:
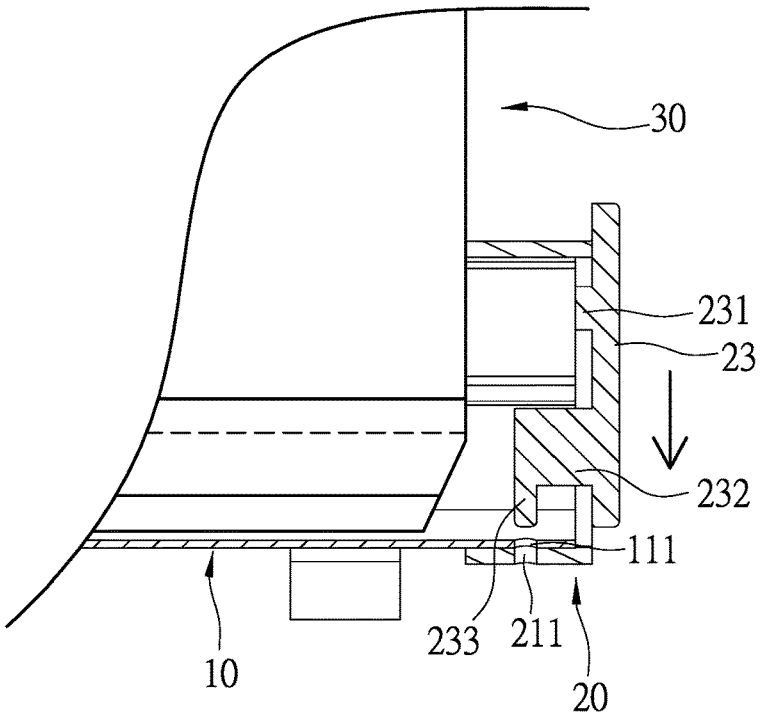
FIG. 3 is a schematic diagram of the assembly of the cover cap according to the preferred embodiment of the present invention.
Figure 4:
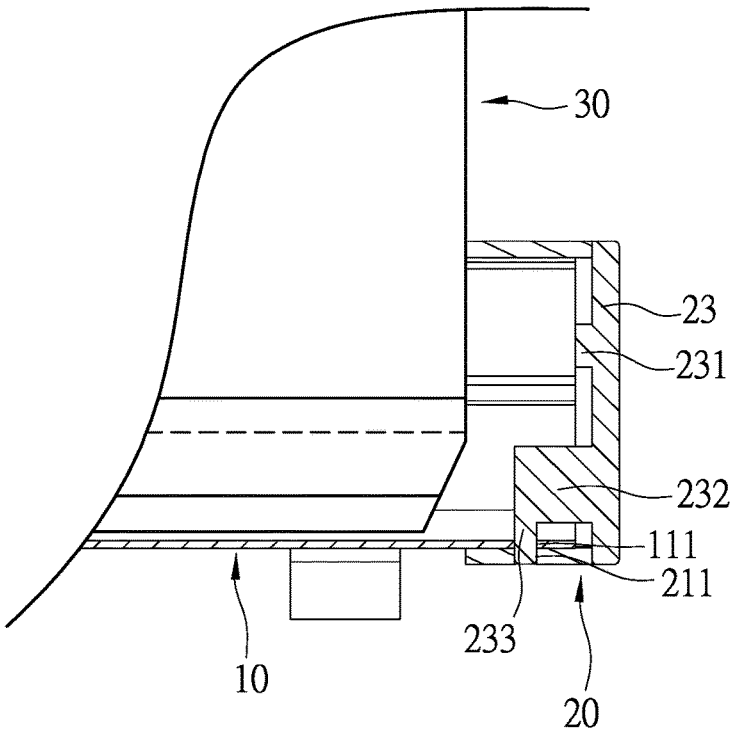
FIG. 4 is a schematic diagram showing the cover cap group being fastened according to the preferred embodiment of the present invention.
Figure 5:
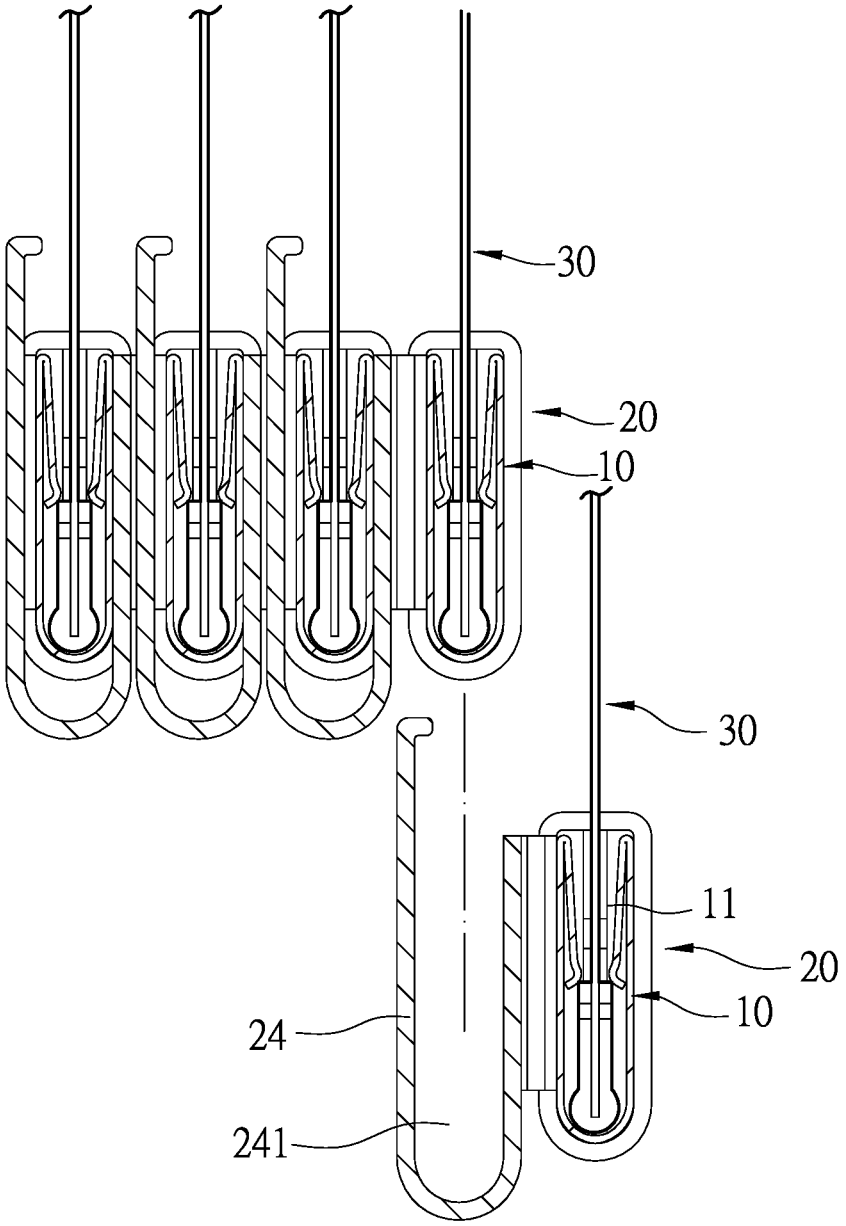
FIG. 5 is a schematic diagram showing the hanging weight member being connected in series via the connecting member according to the preferred embodiment of the present invention.
Figure 6:
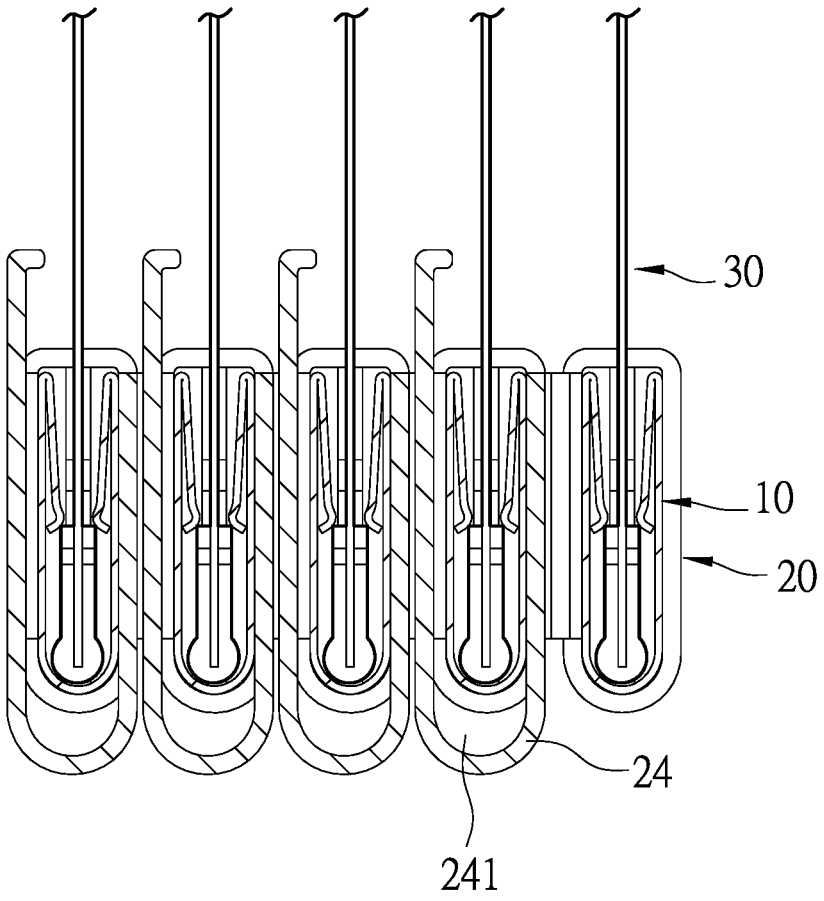
FIG. 6 is a schematic diagram showing a plurality of the hanging weight members being connected in series according to the preferred embodiment of the present invention.

First, please refer to FIG. 1 and FIG. 2. a hanging weight structure for a curtain comprises a hanging weight member 10 and two cover caps 20. A top portion of the hanging weight member 10 has a assembling slot 11 configured for accepting a bottom portion of a curtain sheet 30. An engaging hole 111 is disposed at a bottom of both ends of the hanging weight member 10. The two cover caps 20 respectively jacketed onto two ends of the hanging weight member 10. One side of the cover cap 20 has a socket 21 for accepting one end of the hanging weight member 10, and the socket 21 further has a through aperture 211 connected to the engaging hole 111. Another side of the cover cap 20 has an extended aperture connected to an extended aperture 22 connected to the socket 21. Furthermore, the cover cap 20 further has a positioning plate 23, with a limiting block 231 and a slider 232 on one side, and the positioning plate 23 is slidably assembled on the extended aperture 22 via the limiting block 231 and he slider 232. The slider 232 further has a snap rib 233 engaging with the through aperture 211 of the cover cap 20 through the engaging hole 111 of the hanging weight member 10. One of the cover caps 20 has a connecting member 24 from the socket 21 toward the hanging weight member 10. The connecting member 24 has concave shape 241 capable of accepting another hanging weight member 10, a dividing member 242 disposed between the connecting member 24 and the cover cap 20, and a separating space 243 is defined by the dividing member 24, the cover cap 20 and another hanging weight member 10. Moreover, another cover cap 20 has a positioning bar 25 parallel to the hanging weight member 10 and is disposed at a same side as the connecting member 24 for positioning.

The composition of its structure, as shown in FIGS. 1 to 7, the curtain unit has an upper rail 40 and a plurality of sliding s brackets 41 that capable of sliding along the upper rail 40 to form synchronous deployment and retraction. The sliding brackets 41 are respectively connected to the upper ends of a plurality of the curtain sheets 30, and the lower ends of the plurality of the curtain sheets 30 are respectively installed with a hanging weight member 10. The hanging weight member 10 is a slideably mounted on the lower ends of the curtain sheet 30, the two cover caps 20 are respectively installed at the two ends of the hanging weight member 10 with the sockets 21, and then the positioning plate 23 assembled on the outside of each the cover cap 20 slides down along the extended aperture 22, and then the snap rib 233 of the positioning plate 23 engages with the through aperture 211 of the cover cap 20 through the engaging hole 111 of the hanging weight member 10, so as the two cover caps 20 are connect and secure on the hanging weight member 10 at both ends, which restrict the curtain sheet 30 from slipping and falling off. Furthermore, another cover cap 20 uses the connecting member 24 to be attached to another hanging weight member 10, to make the hanging weight member 10 to slide and move along the other hanging weight member 10 via the connecting member 24 to achieve the purpose of unfolding the hanging weight members 10. Moreover, the same end of the other hanging weight member 10 is also assembled with a connecting member 24 of another cover cap 20 for linking to another hanging weight member 10, so that a plurality of the hanging weight members 10 can be linked in sequence and the hanging weight members 10 are simultaneously unfolded or retracted, thereby preventing the hems of the curtain sheets 30 from being disordered and tangled.

Figure 7:
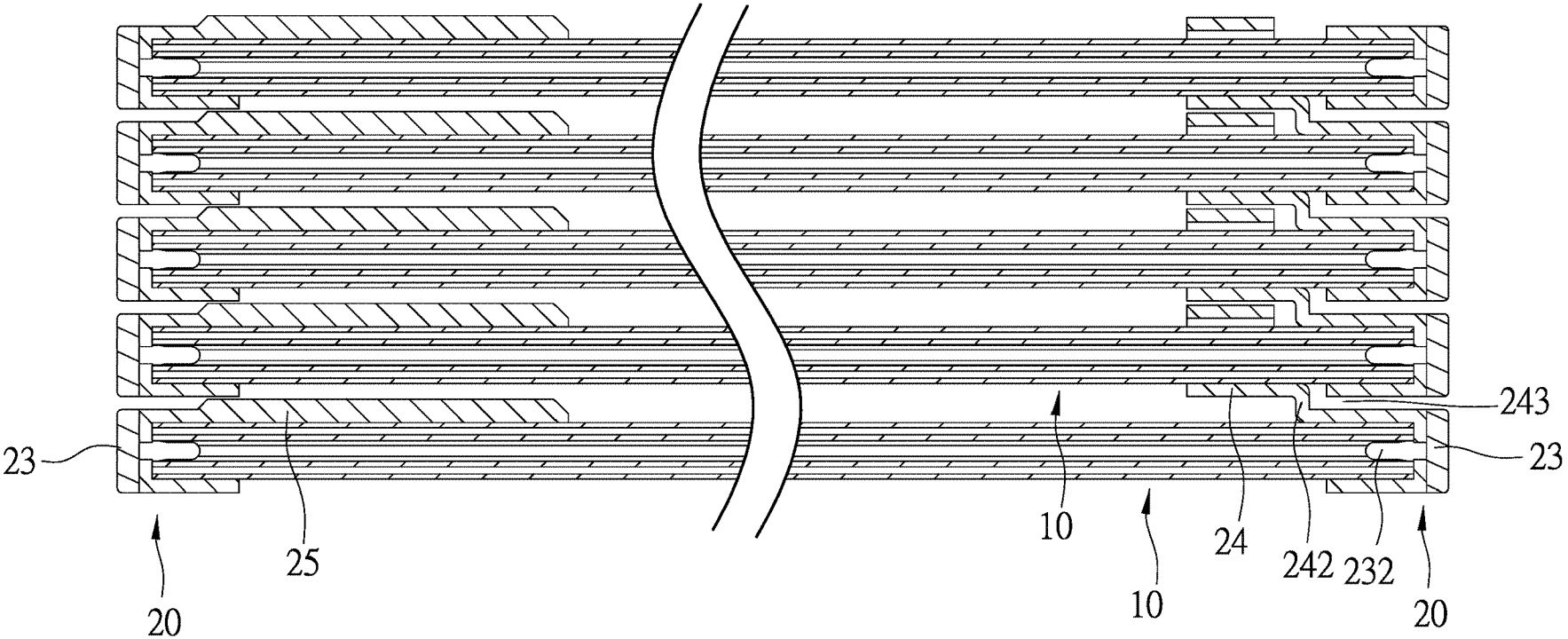
FIG. 7 is a schematic diagram showing a plurality of collected hanging weight members being arranged side by side and connected in series according to the preferred embodiment of the present invention.
Figure 8:
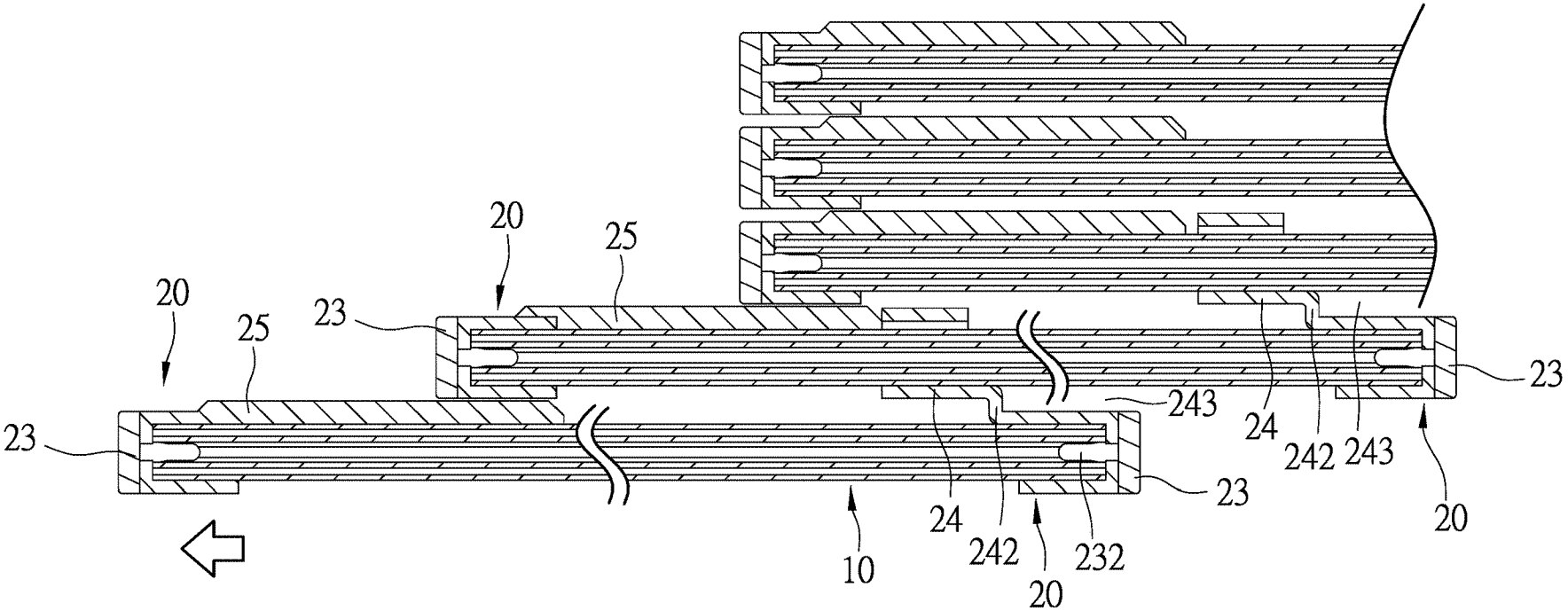
FIG. 8 is a schematic diagram showing the unfolded state of the hanging weight member being pulled out according to the preferred embodiment of the present invention.

For the actual use, please refer to FIG. 1, with FIG. 7 and FIG. 8. when the curtain sheets 30 of the curtain unit are not unfolded and collected by the sliding brackets 41 on one side of upper rail 40, the hanging weight members 10 attached at the lower ends of the curtain sheet 30 are also collected, and each connecting member 24 provides the separating space 243 to accept and limit the adjacent cover cap 20 to ensure that each of the hanging weight members 10 are aligned in flush. When the user pulls the sliding brackets 41 out along the upper rail 40, the curtain sheets 30 unfold as the sliding brackets 41 slide, and the hanging weight members 10 on the bottom of the curtain sheets 30 are pulled synchronously, each hanging weight member 10 moves along the next hanging weight member 10 via the connecting member 24; when the other curtain sheet 30 is continuously pulled out by the other sliding brackets 41 and unfolded, the other hanging weight members 10 are also pulled out by the other curtain sheets 30 via the connecting members 24 attached to the adjacent hanging weight members 10 in series, so as to expands the curtain sheets 30 in sequence for shading. In addition, the hem of the curtain sheets 30 can also be connected to each other through the hanging weight member 10, which also prevent the curtain sheet 30 from being blown by the wind and causing the hem to be disordered and tangled.

In addition, when the hanging weight member 10 moves with another hanging weight member 10 via the connecting member 24, another hanging weight member 10 uses the positioning bar 25 of another cover cap 20 positioning and limiting the connecting member 24 of the hanging weight member 10, thereby limiting the pulling distance of each hanging weight member 10; and at the same time, the length of the positioning bar 25 is used to increase the overlapping area of each the curtain sheet 30 when unfolded, thereby improving the shading effect of the curtain unit.

With the above-mentioned specific structure, the following benefits can be obtained: The hanging weight member 10 is respectively provided with the connecting member 24 on the side of a cover cap 20, and the connecting member 24 is attached to the adjacent Another hanging weight member 10 is connected in series, so that when the hanging weight member 10 is installed at the lower end of the curtain sheet 30, it can be connected with each other through the connecting member 24 at the same time, so as to ensure the stability of the hem of a plurality of the curtain sheet 30 and the order of the curtain sheets 30 can maintain during the collecting or unfolding process. Also, another cover cap 20 is equipped with the positioning bar 25 limiting the connecting member 24, which increases the overlapping area of the curtain sheets 30 when unfolded for better shading and dimming effect.

Although the present invention has been explained in relation to its preferred embodiment, it is to be understood that many other possible modifications and variations can be made without departing from the spirit and scope of invention as hereinafter claimed.

What is claimed is:

1. A hanging weight structure for a curtain comprising:

a hanging weight member, and two cover caps;

wherein:

a top portion of the hanging weight member comprises an assembling slot configured for accepting a curtain sheet;

one side of each cover cap has a socket for accepting a respective end of the hanging weight member so that the two cover caps are respectively jacketed onto two ends of the hanging weight member;

one of the two cover caps has a connecting member positioned to be adjacent to a first side of the hanging weight member and disposed between the socket of the one of the two cover caps and the other of the two cover caps, the connecting member having a concave shape capable of accepting an adjacent hanging weight member, a dividing member connecting the connecting member and the cover cap, wherein a separating space is defined by the dividing member, the cover cap, and the adjacent hanging weight member, the separating space configured to accept an adjacent portion of a cover cap of the adjacent hanging weight member; and the other of the two cover caps has a positioning bar adjacent to the hanging weight member on the first side of the hanging weight member.

2. The hanging weight structure for a curtain as claimed in claim 1, wherein an engaging hole is disposed at a respective bottom of the two ends of the hanging weight member, each socket of the two cover caps further has a through aperture at a bottom configured to align with one of the engaging holes, and another side of each cover cap has an extended aperture;

each cover cap further has a positioning plate with a limiting block and a slider on a side of the positioning plate, and the positioning plate is slidably assembled on the extended aperture via the limiting block and the slider, and the slider further has a snap rib configured to engage with the through aperture of the cover cap and one of the engaging holes of the hanging weight member.

3. The hanging weight structure for a curtain as claimed in claim 2, wherein the connecting member extends from the socket of the cover cap towards an opposite end of the hanging weight member.

* * * * *